United States Patent [19]

Miska

[11] 4,358,497

[45] Nov. 9, 1982

[54] PILE WEATHERSTRIP HAVING A DIAMOND-SHAPED BARRIER FIN AND METHOD OF MANUFACTURE

[75] Inventor: Stanley R. Miska, Rochester, N.Y.

[73] Assignee: Schlegel Corporation, Rochester, N.Y.

[21] Appl. No.: 239,894

[22] Filed: Mar. 3, 1981

[51] Int. Cl.[3] ..... D04H 11/00; E06B 7/22

[52] U.S. Cl. ..... 428/85; 49/475; 49/489; 156/1; 156/72; 156/217; 156/227; 428/88; 428/89; 428/92; 428/358; 428/900

[58] Field of Search ..... 428/85, 88, 89, 92, 428/900, 358; 156/72, 1, 217, 227; 49/475, 489

[56] References Cited

U.S. PATENT DOCUMENTS 4,214,930 7/1980 Burrous ..... 428/85

*Primary Examiner*—Marion McCamish

*Attorney, Agent, or Firm*—Cumpston & Shaw

[57] ABSTRACT

A weatherstrip and method for making the weatherstrip for use in sealing the space between fixed and movable members. The weatherstrip comprises a backing strip having a sealing body affixed thereto to form a sealing assembly, and a barrier fin secured at one edge to the sealing assembly. The barrier fin comprises a pair of leafs transverse to the backing strip. A longitudinal fold line in each leaf defines a leaf portion extending outwardly from the backing strip and toward the other leaf portion. The leaf portions are sealed together to form a hollow fin of substantially diamond-shaped cross section.

17 Claims, 5 Drawing Figures

PILE WEATHERSTRIP HAVING A DIAMOND-SHAPED BARRIER FIN AND METHOD OF MANUFACTURE

BACKGROUND OF THE INVENTION

1. Field of the Invention

The present invention relates generally to weatherstrips. More particularly, the invention relates to an improved pile weatherstrip of the type having a sealing assembly comprising at least one sealing body affixed to a backing strip, and a barrier fin secured at one edge to the sealing assembly. The invention further relates to a method of manufacturing the weatherstrip.

2. Description of the Prior Art

U.S. Pat. No. 4,214,930 discloses a weatherstrip having a backing strip, at least one sealing body having a surface portion affixed to the backing strip, and a flexible barrier film fixed at one edge thereof to the backing strip. The opposite free edge of the film extends beyond the opposite free edge portion of the sealing body for a substantial distance.

U.S. Patent Application Ser. No. 108,399 describes a weatherstrip having a backing strip, at least one sealing body affixed thereto, and a barrier film of loop-shaped cross section affixed to the backing strip adjacent the sealing body. The loop-shaped film is formed from a web of material folded upon itself with one edge portion thereof secured to the backing strip, and an opposite looped portion extending from the strip. In one embodiment, the loop-shaped film is filled with a foam material.

SUMMARY OF THE INVENTION

It is a primary object of the present invention to provide an improved pile weatherstrip and method of manufacturing it.

Briefly, the improved weatherstrip comprises at least one sealing body having a surface portion thereof affixed to one face of a backing strip to form a sealing assembly. A flexible barrier fin has one edge portion thereof affixed to the sealing assembly. The barrier fin comprises a pair of longitudinally extending leafs transverse to the face of the backing strip. Each leaf has a first fold line defining a leaf portion extending outwardly from the backing strip toward the other leaf. The leaf portions are further sealed together along a seal line to form a hollow fin of substantially diamond-shaped cross section.

In another aspect of the invention, the hollow fin is filled with a resilient material to combat compression set of the fin, provide longer fin life, and higher quality air infiltration resistance.

In still another aspect of the invention, each of the leaf portions has a second fold line substantially along the seal line, the second fold lines forming free end portions of the leaf portions extending away from one another and overhanging the free surface portions of the sealing bodies.

One of the primary advantages of this invention, for example, is to provide an improved pile weatherstrip having a hollow fin that can be manufactured reliably, efficiently, and economically.

The invention and its advantages will become more apparent from the detailed description of the invention presented below.

BRIEF DESCRIPTION OF THE DRAWINGS

The details of this invention will be described in connection with the accompanying drawings, in which.

DETAILED DESCRIPTION OF THE INVENTION

Figure 1:
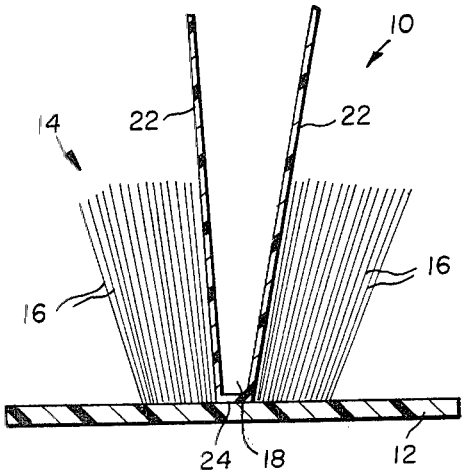
FIG. 1 is a cross-sectional view of a pile weatherstrip showing a barrier fin comprising a pair of leafs in an untrimmed condition.

Referring to FIG. 1 of the drawings, the cross-sectional view of a pile weatherstrip 10 is shown in an unfinished state. The weatherstrip comprises a base or backing strip 12 which, in one of its forms, is preferably woven of textile fibers, either natural or synthetic, as is well known in the art. Backing strip 12 has affixed thereto sealing bodies 14 of preferably up-standing resilient pile fibers 16 which may be either cut or un-cut. Such fibers may be of known plastic materials such as polypropylene, nylon, orlon, or may be made of natural fibers such as mohair, goat hair, wool, jute or the like, or any combination thereof. Pile fibers 16 may be fixed to backing strip 12 by mechanical embedments, flocking, tufting, or other known methods. Backing strip 12 preferably has its marginal edges extending beyond the pile fibers for ease in mounting the strip. The sealing bodies 14 of pile fibers 16 are affixed to the backing strip in spaced relation to form a narrow, longitudinally extending gap 18 intermediate its marginal edges for receiving a barrier fin 20.

Barrier fin 20 comprises a relatively thin flexible film or sheet of a known organic or inorganic thermoplastic or thermo setting material such as vinyl, nylon, glass fiber fabric coated with vinyl, polypropylene, polyethylene, or other known material. The film is folded upon itself to form two leafs 22 with a fold 24 at the bottom secured to backing strip 12 along gap 18 by heat welding, suitable adhesives or other known means as is well understood in the art. Barrier fin 20 may also be secured to the adjacent pile fibers 16 in addition to or instead of being attached to backing strip 12. Barrier fin 20 is thus resiliently supported along backing strip 12 and serves to increase the resistance of the weatherstrip 10 to wind, rain or other elements that might otherwise penetrate the weatherstrip.

Figure 2:
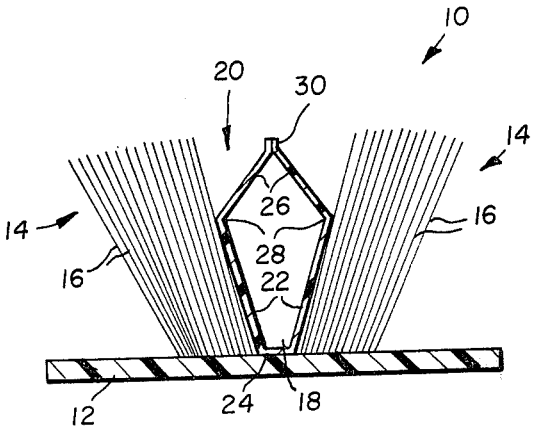
FIG. 2 is a cross-sectional view similar to FIG. 1 in which the leafs have been folded, sealed together along a seam line, and trimmed to form a hollow diamond-shaped barrier fin.

With reference to FIG. 2, a preferred embodiment of the weatherstrip 10 of this invention is shown in a finished state. In this embodiment, leafs 22 of the type shown in FIG. 1 are subjected to any suitable folding operation by any suitable means for folding or bending leaf portions 26 along fold lines 28 toward and into engagement with one another. The fold lines 28 may be temporary or permanent. Sealing means of any suitable type, such as heat sealing means, seal the leaf portions 26 together along a seal line 30 to form closed hollow fin 20 of substantially diamond-shaped cross section. The weatherstrip 10 is completed by cutting leaf portions 26 along seal line 30 by any suitable film cutting means, and removing the excess leaf material.

The height of the diamond-shaped fin 20 obtained by the manufacturing method may be changed, for example, by varying the angle of fold of the leaf portions 26. This in turn varies the length and portion of engagement of the leaf portions.

Figure 3:
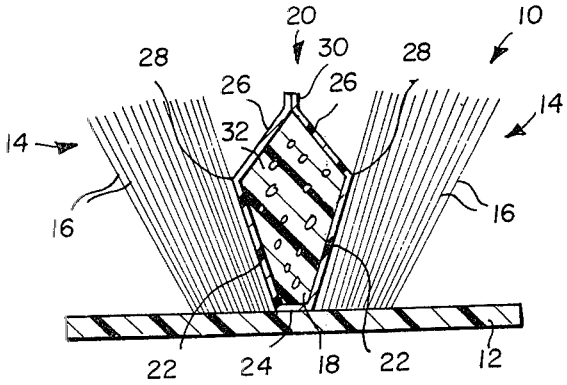
FIG. 3 is a cross-sectional view similar to FIG. 2 showing the hollow fin filled with a resilient material.

Referring to FIG. 3, another embodiment of weatherstrip 10 is illustrated in which the hollow fin 20 is filled with any suitable resilient material 32, such as rubber, plastic foam material, or the like. The resilient material 32 assists in returning a compressed fin 20 to its normal uncompressed portion, thereby overcoming any compression set in the fin that may occur during use. If the hollow fin 20 is filled with a magnetic filler material, for example, the weatherstrip is particularly useful for sealing a space between ferrous members, not shown. The magnetic attraction between the filler material and ferrous member releasably secures engaging surfaces of the fin and member together, thereby increasing the seal between the two surfaces.

Figure 4:
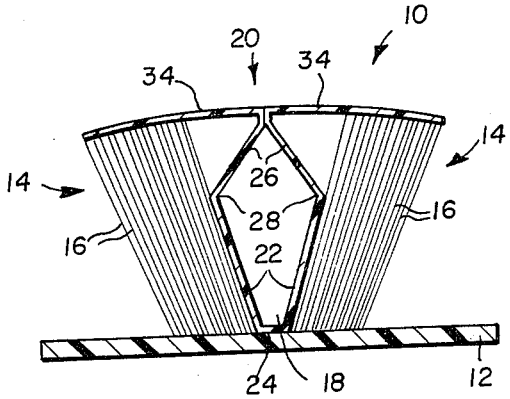
FIG. 4 is a cross-sectional view similar to FIG. 2 showing another embodiment of the diamond-shaped barrier fin of this invention.

With reference to FIG. 4, another embodiment of the weatherstrip 10 of the invention is illustrated in which the cutting step for cutting the leafs 22 along seal line 30 is omitted. Instead, the sealing step has incorporated therein a folding or bending function, not shown, for folding the free end portions 34 of the leafs over the top of the adjacent sealing bodies 14 of pile fibers 16. If desired, the folding step may be a separate operation following the sealing step.

Figure 5:
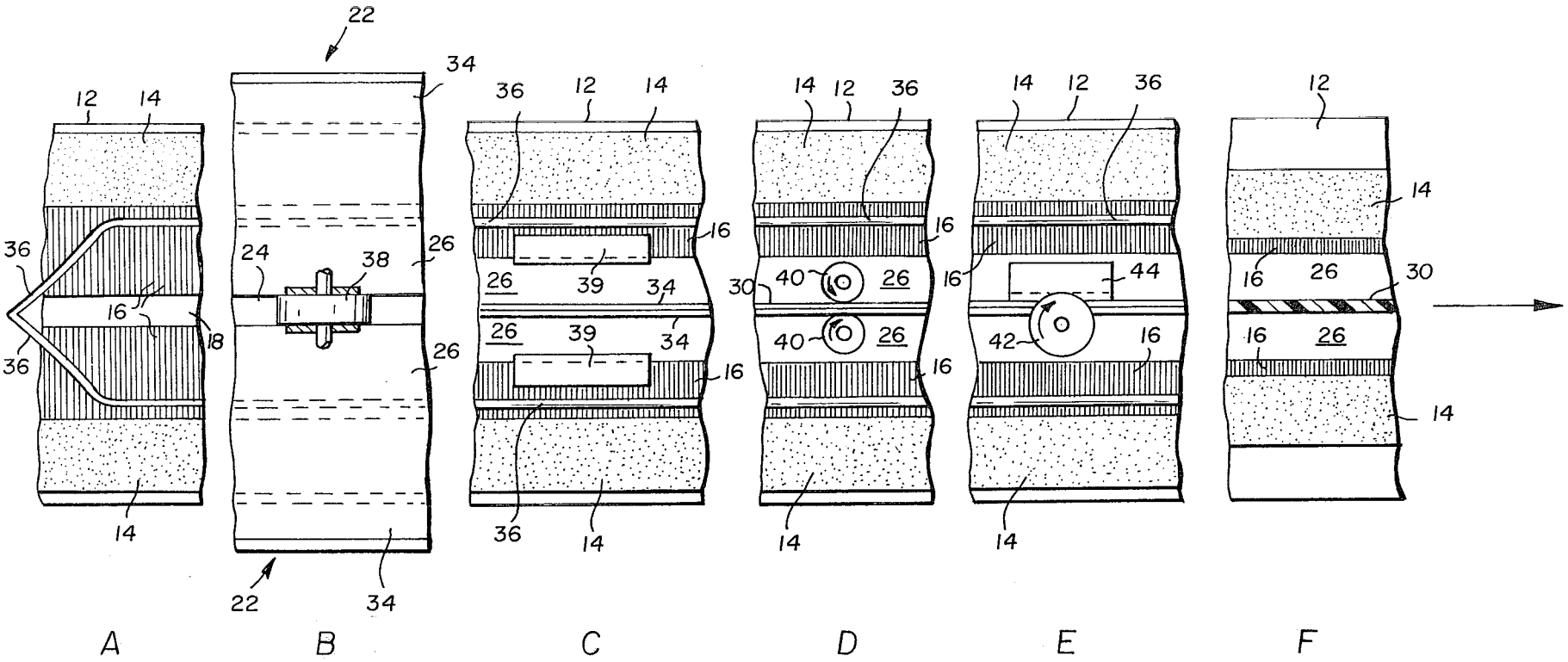
FIG. 5 is a top plan view of sequential stations of a production line showing a method for manufacturing a weatherstrip incorporating the diamond-shaped barrier fin of this invention.

Referring to FIG. 5, an exemplary method for manufacturing a weatherstrip 10 of this invention comprises transporting a backing strip 12, to which spaced sealing bodies 14 have been previously affixed by means well known in the art, in the direction indicated by the arrow. The backing strip 2 is transported through a spreading station A where spreading means, such as curved rods 36, enter gap 18 between sealing bodies 14 and spread them apart. At the next fin inserting station B, a film is folded upon itself forming leafs 22 and a folded bottom 24 of a barrier fin 20 which is guided into the gap and secured by heated means, such as a roller 38, to backing strip 12. The backing strip is then fed through a leaf folding station C where leafs 22 are folded by folding guides 39 causing leaf portions 26 to move into face-to-face engagement. At the next sealing station D, heat seal rollers 40 or the like are provided for sealing the leaf portions 26 together along a seal line 30. At the next leaf cutting station E, cutting means, such as a rotatable blade 42 and slotted anvil 44, for example, are provided for cutting fin 20 along seal line 30 for removing the excess leaf material. The completed weatherstrip 10, shown at the last station F, is fed to any suitable take-up means, such as a reel, not shown. It, of course, should be understood that the mechanisms shown at the various stations for accomplishing stated functions are exemplary only, and any other suitable mechanisms may be used.

In the manufacture of a weatherstrip 10 of the type shown in FIG. 3, an additional resilient material filling station, not shown, is provided, preferably between stations B and C, for inserting the resilient material between leafs 22.

In the manufacture of a weatherstrip 10 of the type shown in FIG. 4, the cutting station E is eliminated, and additional folding means are provided, preferably at sealing station D, for folding the free end portions 34 of the leaf material over the top of the sealing bodies 14.

While presently preferred embodiments of the invention have been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A pile weatherstrip having a diamond-shaped barrier fin comprising:

a backing strip;

at least one sealing body having one surface portion thereof fixed to one face of said backing strip and extending longitudinally thereof and cooperating therewith for forming a sealing assembly, said sealing body extending from said one face and having an opposite free surface portion; and a flexible barrier fin fixed adjacent one edge portion thereof to said sealing assembly, said fin comprising a pair of longitudinally extending leafs transverse to said one face, and a first fold line in each leaf defining a leaf portion extending outwardly from said backing strip and toward said other leaf portion, said leaf portions further being sealed together along a seal line to form a hollow fin of substantially diamond-shaped cross section.

2. A pile weatherstrip according to claim 1 wherein said hollow fin is filled with a resilient material.

3. A pile weatherstrip according to claim 2 wherein said resilient material is a foam or rubber material.

4. A pile weatherstrip according to claim 2 wherein said resilient material is a magnetic material.

5. A pile weatherstrip according to claim 1 wherein at least one of said leaf portions has a second fold line substantially along said seal line to form a free end portion overhanging said free surface portion of said sealing body.

6. A pile weatherstrip according to claim 1 wherein a pair of sealing bodies are fixed to said backing strip, said sealing bodies being spaced apart to define a gap for receiving said barrier fin, and each of said leaf portions has a second fold line substantially along said seal line, said second fold lines forming free end portions of said leaf portions extending away from one another and overhanging said free surface portions of said sealing body.

7. A pile weatherstrip according to claim 6 wherein said hollow fin is filled with a resilient material.

8. A pile weatherstrip according to claim 7 wherein said resilient material is a foam or rubber material.

9. A pile weatherstrip according to claim 6 wherein said resilient material is a magnetic material.

10. A method for manufacturing a pile weatherstrip having a substantially diamond-shaped hollow barrier fin comprising the steps of:

securing at least one sealing body to a backing strip to form a sealing assembly;

folding a film to form a bottom fold and a pair of up-standing leafs and securing the folded film to the sealing assembly;

folding the leafs intermediate their ends so that free end portions of the leafs are moved toward one another;

sealing the free end portions of the leafs together along a seal line to form a substantially diamond-shaped hollow barrier fin; and cutting the leafs along the seal line to remove the excess free ends of the free end portions of the leafs whereby a weatherstrip is formed having a substantially diamond-shaped hollow barrier fin.

11. A method for manufacturing a pile weatherstrip according to claim 10 wherein in the leafs folding step the free end portions are moved into face-to-face engagement.

12. A method for manufacturing a pile weatherstrip according to claim 10 comprising the further step of filling the hollow carrier fin with a resilient material.

13. A method for manufacturing a pile weatherstrip according to claim 10 comprising the further step of filling the hollow barrier fin with a magnetic resilient material.

14. A method for manufacturing a pile weatherstrip having a substantially diamond-shaped hollow barrier fin comprising the steps of:

securing at least one sealing body to a backing strip to form a sealing assembly;

folding a film to form a bottom fold and a pair of up-standing leafs and securing the folded film to the sealing assembly;

folding the leafs intermediate their ends so that leaf portions are moved toward one another;

sealing the leaf portions together along a seal line to form a substantially diamond-shaped hollow barrier fin connected to free end portions of the leafs; and folding at least one of the free end portions over the sealing body whereby a weatherstrip is formed having a substantially diamond-shaped hollow barrier fin.

15. A method for manufacturing a pile weatherstrip according to claim 14 wherein in the leafs folding step the leaf portions moved into face-to-face engagement.

16. A method for manufacturing a pile weatherstrip according to claim 14 comprising the further step of filling the hollow barrier fin with a resilient material.

17. A method for manufacturing a pile weatherstrip according to claim 14 comprising the further step of filling the hollow barrier fin with a magnetic resilient material.

* * * * *